US005679014A

United States Patent [19]

Lan-Jen

[11] Patent Number: 5,679,014

[45] Date of Patent: Oct. 21, 1997

[54] THIN POWER PLUG

[76] Inventor: Tsang Lan-Jen, No. 1, Lane 199, Min Chuan Rd., Tainan, Taiwan

[21] Appl. No.: 621,624

[22] Filed: Mar. 26, 1996

[51] Int. Cl.[6] ..... H01R 13/62

[52] U.S. Cl. ..... 439/160; 439/484

[58] Field of Search ..... 439/160, 484, 439/372, 163, 258, 159, 157, 152, 483

[56] References Cited

U.S. PATENT DOCUMENTS

| | | | |
|---|---|---|---|
| 2,134,345 | 10/1938 | Sheeran | 439/160 |
| 2,507,092 | 5/1950 | Cline | 439/484 |
| 3,079,490 | 2/1963 | Barbieri | 439/160 |
| 4,857,013 | 8/1989 | Peters | 439/484 |
| 5,567,181 | 10/1996 | Lentz et al. | 439/484 |

*Primary Examiner*—J. J. Swann

*Attorney, Agent, or Firm*—Morton J. Rosenberg; David I. Klein

[57] ABSTRACT

A thin safety power plug is provided which includes an upper bayonet cap, a lower bayonet cap, an upper retainer, a lower retainer, a pulling lever and a pair of pins. The power plug is designed to overcome the defects of existing power plugs, the improvement facilitating the removal of the plug from a wall socket easily and safely. The power plug makes use of the lever action between the pulling lever and the wall socket.

3 Claims, 5 Drawing Sheets

THIN POWER PLUG

BACKGROUND OF THE INVENTION

1. Field of the Invention

This invention relates to a thin easily unplugged power plug. In particular, the present invention is directed to a safety plug which prevents disconnection caused by accidental colliding and pulling.

2. Prior Art

Now, most household appliances are electrically controlled and require electric power from a wall socket by means of a power plug. The utilization of electric power has become an important part of family life. As well known, the electric voltage of a residential area is supplied with either 110V or 220V. Users always have some basic knowledge and use electricity with caution to prevent themselves from getting an electric shock or causing sparking. Some children like to play with a wall socket by inserting their fingers or other objects therein and get electric shock. So, a safety plug, as shown in FIG. 5, was developed which includes a plug pin A and an electric cord B embedded in a bayonet cap by molding directly with melting plastic forming a thin shaped plug with the electric cord extending laterally. While the plug A is plugged into a wall socket, the thin power plug A nests closely to the wall. Thus, the plug A is not easy to pull out, even by pulling the cord B. In addition, there is a pull ring C on the bayonet cap for the user to grasp with a finger to pull the plug A out. But this thin plug A exhibits shortcomings as follows:

1. Because the bayonet cap is injection molded while the pins are in an unstable state, the rejection rate will be increased if the pins and the cord are not positioned accurately.
2. The size of the pulling ring is too small to insert a finger, and it is not easy to pull the plug out.
3. Since the size of the pulling ring is too small, it often hurts the user's finger.

SUMMARY OF THE INVENTION

It is an object of the present invention to provide a new thin power plug eliminating those defects mentioned above, in which, two pins and an electric cord are held by upper and lower retainers, and are enclosed within an upper and a lower bayonet cap which comprises a pulling lever adapted to be held by user to pull the plug from a wall socket.

It is another object of the present invention to provide a thin power plug which is easy to use.

It is a further object of the present invention to provide a thin power plug which is inexpensive to produce.

DETAILED DESCRIPTION OF THE PREFERRED EMBODIMENTS

Figure 1:
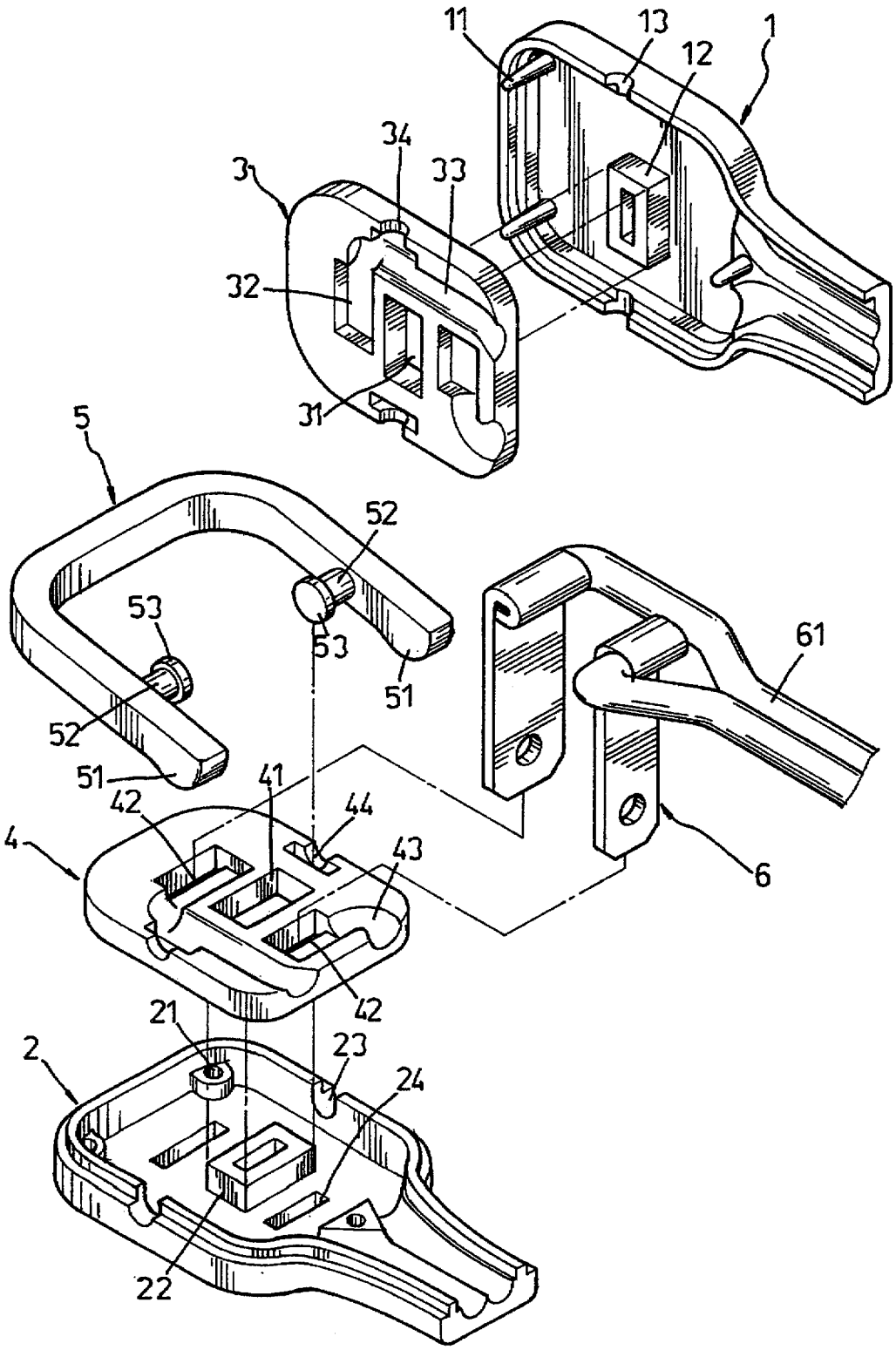
FIG. 1 is an exploded view of the present invention.

Referring to FIG. 1, the present invention comprises an upper half bayonet cap 1, a lower half bayonet cap 2, an upper half retainer 3, a lower half retainer 4, a pulling lever 5, and a pair of pins 6.

The upper bayonet 1 is a hollow cap having a plurality of latches 11 extending from the inner periphery, a projecting block 12 at a center portion and a semi-circular breach 13 on respective sides of the edge.

The lower bayonet cap 2 is a homologue of upper bayonet cap 1 having a plurality of holes 21 along the periphery corresponding to the latch 11 of the upper bayonet cap 1, a projecting block 22 at a center portion, a pair of pin holes 24 at the front and rear sides of the block 22, respectively, and a semi-circular breach 23 on respective sides of the edge.

The upper retainer 3 is made of fireproof material comprising a through hole 31 at a center portion adapted to receive the block 12 of the upper bayonet cap 1 therein, a pair of concave grooves 32 formed at the front and the rear portions of the hole 31, respectively, a pair of concave grooves 33 connected to a corresponding groove 32 adapted to receive an electric cord thereon. A pair of "T" shaped concave grooves 34 are formed at respective sides of the upper retainer 3.

The lower retainer 4 is also made of fireproof material comprising a through hole 41 at a center portion adapted to receive the block 22 of the lower bayonet cap 2 therein, a pair of pin slots 42 formed on the front and the rear portions of the hole 41, respectively, a pair of concave grooves 43 connected to a corresponding pin slot 42, and a pair of "T" shaped concave grooves 44 being formed at respective sides of the lower retainer 4.

The pulling lever 5 is composed of a pair of round heads 51 at respective ends, and a shaft 52 having a stopper 53.

The pins 6 are made of electric conductable material having been welded with electric cords 61.

Figure 2:
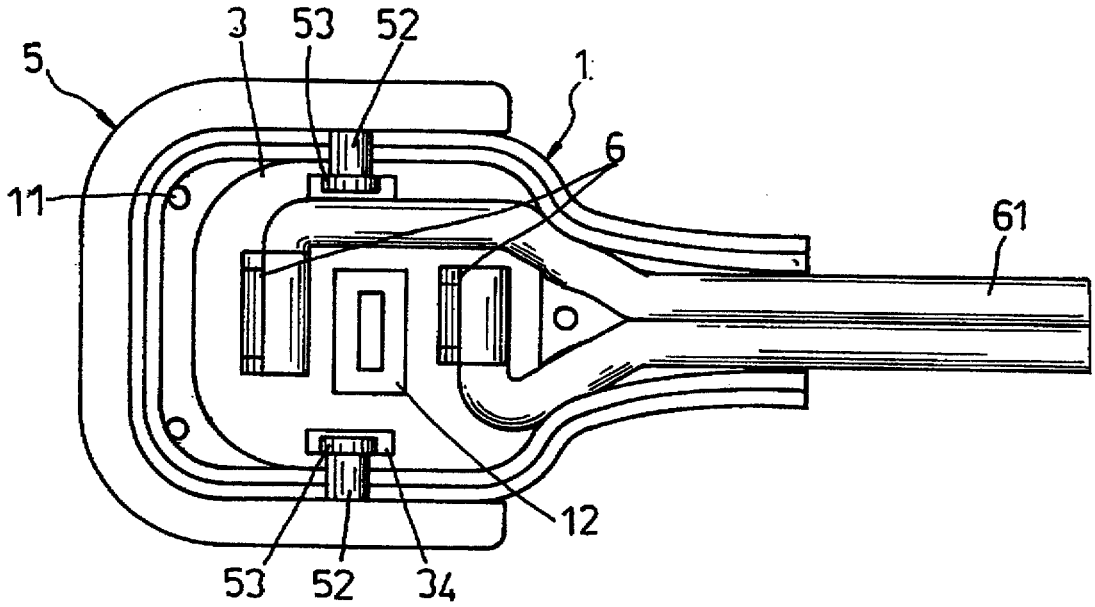
FIG. 2 is a cross-sectional view of FIG. 1.

Referring to FIGS. 1 and 2, the procedure of assembling the connector is as follows:

The lower retainer 4 is placed into the lower bayonet cap 2 with the through hole 41 sleeved on the projecting block 22 of the lower bayonet cap 2. The pin slots 42, at this moment, correspond to the pin holes 24 of the lower bayonet cap 2. Then, pins 6 are inserted through pin slots 42 allowing the cord 61 to be laid into the concave grooves 43 of the lower retainer 4. The pulling lever 5 is placed into the lower bayonet cap 2 and the lower retainer 4 with the stopper 53 of the shaft 52 laying into the "T" concave grooves 44 of the lower retainer 4 and the semi-circular breach 23 of the lower bayonet cap 2. Furthermore, the lower retainer 4 is covered with the upper retainer 3 so the cord 61 and the pins 6 are fixed within the concave grooves 33 and 32 of the upper retainer 3, respectively. The shaft 52 and the stopper 53 of the pulling lever 5 are thereby securely clipped in the gap between the "T" concave grooves 34 of the upper retainer 3 and the grooves 44 of the lower retainer 4. Lastly, the lower bayonet cap 2 is covered with the upper bayonet cap 1, with the projecting block 12 and latches 11 of the upper bayonet cap 1 inserting into the through hole 31 of the upper retainer 3 and the hole 21 of the lower bayonet cap 2, the joining area then being sealed by an ultrasonic wave treatment.

Figure 3A:
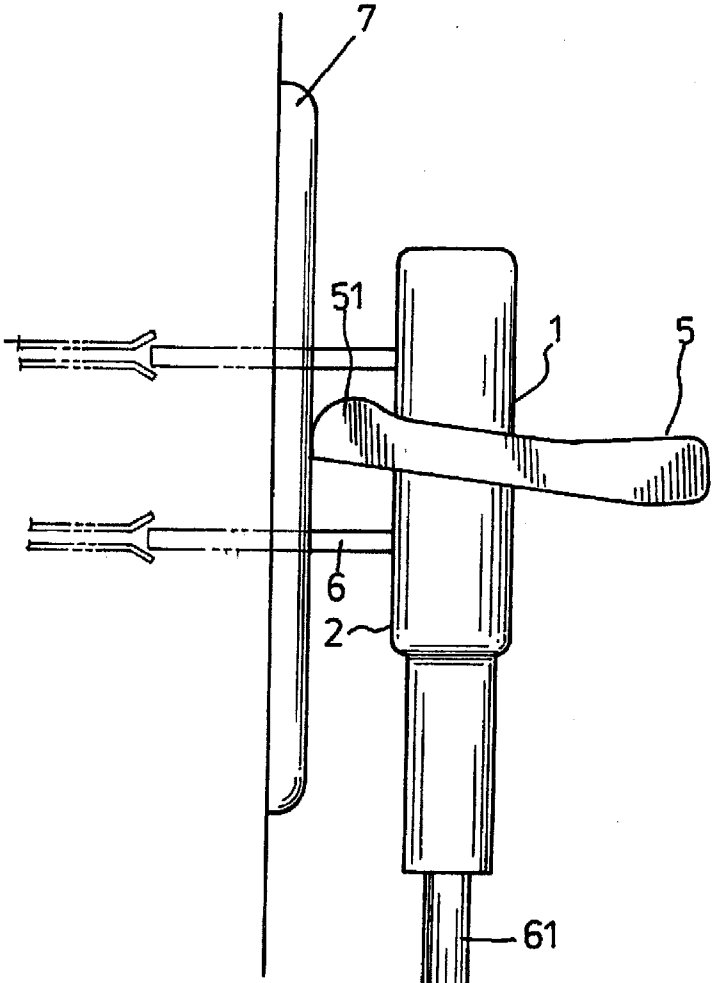
FIG. 3A is another performance sketch of the present inventions.
Figure 3:
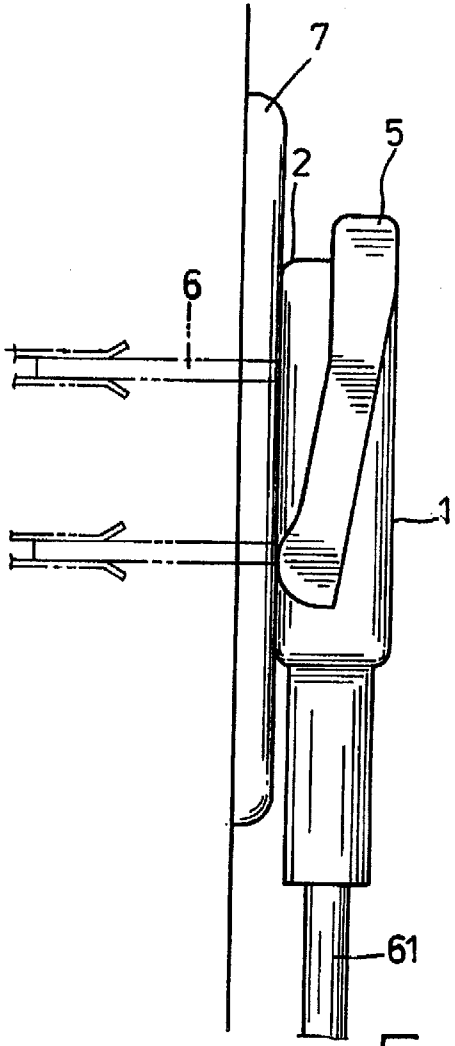
FIG. 3 is a performance sketch of the present invention.
Figure 4:
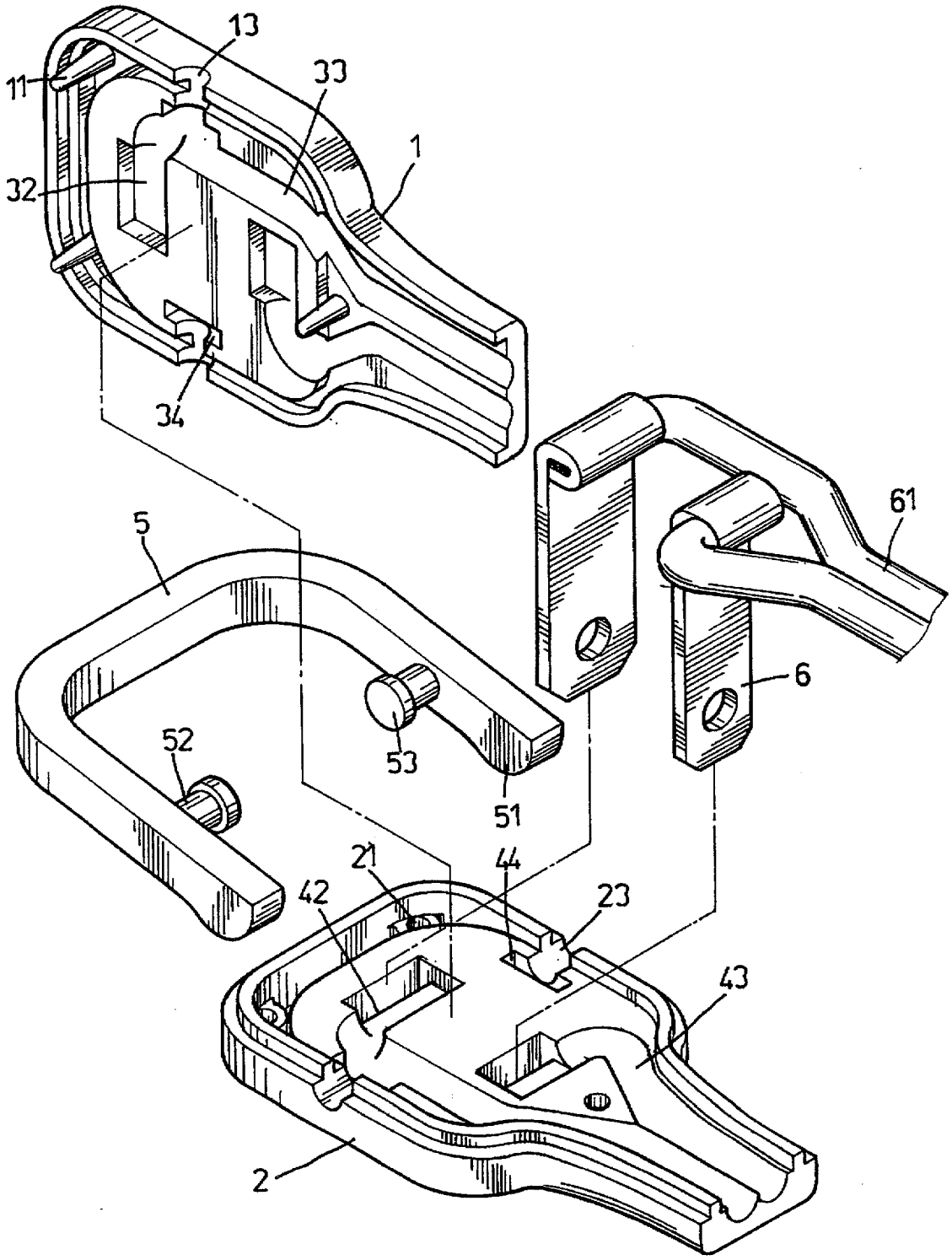
FIG. 4 is a perspective view of a second embodiment of the thin power plug.
Figure 5:
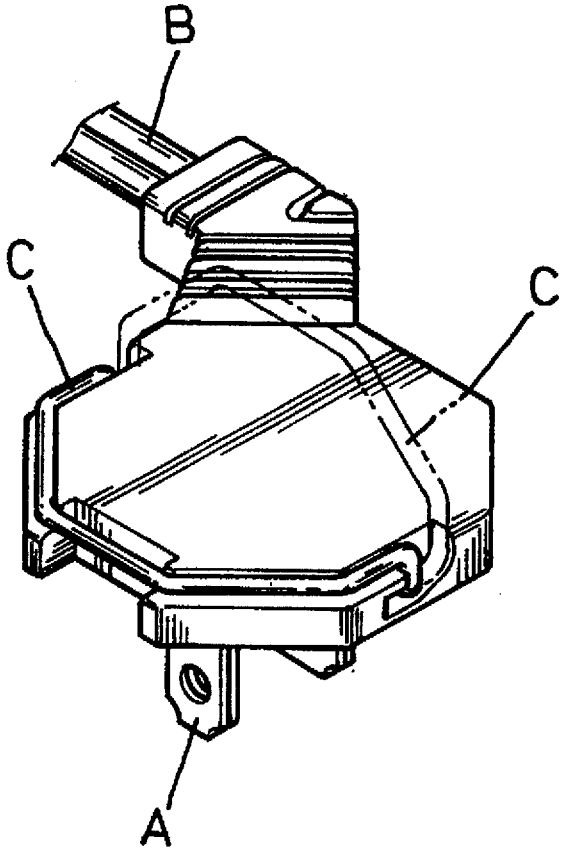
FIG. 5 (PRIOR ART)
FIG. 5 is a perspective view of a prior art plug.

When the thin plug of the present invention is in use, the pins of the plug are plugged into the power socket 7 directly. If the socket is mounted on a wall, the profile of both the plug and the socket, as shown in FIG. 3, are nested closely to each other.

If when pulling the plug out from the wall socket, the pulling lever 5 is first lifted up and rotated to an angle, and then pulled, this will bring the plug out of the socket easily.

In order to save assembly steps, the upper bayonet cap 1 and the lower bayonet cap 2 can be integrally formed with the upper retainer 3 and the lower retainer 4, respectively. This will not only save the time of assembly, but also save the cost of manufacture.

Moreover, the pins of the plug may be of three phase design to fit various wall sockets.

I claim:

1. A thin power plug comprising an upper bayonet cap, a lower bayonet cap and a pair of pins, each of said upper bayonet cap and said lower bayonet cap having a projecting block at inner center portions, said lower bayonet cap having a pair of semi-circular breaches at respective sides and a pair of through holes formed at the front and the rear portions of said projecting block thereof, said pins being connected with a pair of cords, respectively, and embedded in said upper bayonet cap and said lower bayonet cap, and the improvements comprising:

said upper bayonet cap and said lower bayonet cap having an upper fireproof retainer and a lower fireproof retainer which are adapted to clip said pins and said cords so as to confine movement thereof, one of said retainers having a pulling lever with a shaft and a stopper, each retainer having a through hole adapted to receive respective projecting blocks therein, said upper retainer having a pair of concave grooves and a pair of electric cord grooves connected with said concave groove respectively, said lower retainer having a pair of pin slots and a pair of electric cord grooves corresponding to said concave grooves and said electric cord grooves of said upper retainer, said upper retainer and said lower retainer further comprising a pair of "T" shaped grooves on respective sides thereof for swivably receiving said shaft and said stopper of said pulling lever, wherein when lifting and turning said pulling lever, said plug can be pulled out from a wall socket easily.

2. A thin plug, as recited in claim 1, wherein said upper retainer and said lower retainer can be formed integrally with said upper bayonet cap and said lower bayonet cap, respectively.

3. A thin plug, as recited in claim 1, wherein said pins of said plug is able to be formed in a three phases design.

* * * * *